US006508163B1

(12) United States Patent
Weatherill

(10) Patent No.: US 6,508,163 B1
(45) Date of Patent: Jan. 21, 2003

(54) LIQUID DECANTING AND/OR AERATING DEVICE

(75) Inventor: Neil Kenneth Weatherill, London (GB)

(73) Assignee: Wine Things, Limited, London (GB)

( * ) Notice: Subject to any disclaimer, the term of this patent is extended or adjusted under 35 U.S.C. 154(b) by 0 days.

(21) Appl. No.: 09/806,408

(22) PCT Filed: Sep. 30, 1999

(86) PCT No.: PCT/GB99/03049

§ 371 (c)(1),
(2), (4) Date: May 7, 2001

(87) PCT Pub. No.: WO00/18499

PCT Pub. Date: Apr. 6, 2000

(30) Foreign Application Priority Data

Sep. 30, 1998 (GB) ..... 9821097

(51) Int. Cl.[7] ..... B01F 3/04; A47G 23/02

(52) U.S. Cl. ..... 99/323.1; 99/277.2; 99/275; 261/112.1

(58) Field of Search ..... 99/323.1, 323.2, 99/277.1, 277.2, 275; 261/112.1, DIG. 7, DIG. 14

(56) References Cited

U.S. PATENT DOCUMENTS

| | | | | |
|---|---|---|---|---|
| 1,762,126 A | | 6/1930 | Smith | |
| 1,780,687 A | | 11/1930 | Smith | |
| 3,561,735 A | | 2/1971 | Smith | 261/112.1 |
| 3,901,439 A | | 8/1975 | Willis | 239/12 |
| 4,494,452 A | | 1/1985 | Barzso | 99/323.1 |
| 5,293,912 A | | 3/1994 | Wildash et al. | 141/344 |
| 5,595,104 A | | 1/1997 | Delaplaine | 99/323.1 |
| 5,887,511 A | * | 3/1999 | Cappellotto | 99/323.1 X |

FOREIGN PATENT DOCUMENTS

| | | |
|---|---|---|
| DE | 91 01 760 | 4/1992 |
| DE | 94 13 395 | 11/1994 |
| EP | 0 234 645 A1 | 9/1987 |
| FR | 1005653 | 4/1952 |
| WO | WO 89/06159 | 7/1989 |

* cited by examiner

*Primary Examiner*—Reginald L. Alexander
(74) *Attorney, Agent, or Firm*—Woodard, Emhardt, Naughton, Moriarty & McNett

(57) ABSTRACT

An air-decant device for the aeration and decanting of liquids stored in containers, comprising a pump which can pump air through the device to the liquid in the container and/or pump liquid from the container over an exposed surface or through a special nozzle to create a dome shaped flow of liquid to aerate the liquid before returning it to the container. In addition, the pump can pump liquid from the device via decanting attachment to decant the same to another container.

18 Claims, 10 Drawing Sheets

LIQUID DECANTING AND/OR AERATING DEVICE

The present invention relates to a device for the aeration and/or decanting of liquids stored in containers, and particularly to a device for use with wines and spirits.

It is important for liquids, such as wines and spirits, to breath/aerate sufficiently before human consumption to enhance the flavour of the same. Conventionally wines and spirits are aerated by manually decanting the liquid from one container to another. This is a time consuming operation and needs to be performed well in advance of consumption of the liquid. Alternative methods are sometimes used but none adequately aerate the liquid without undergoing lengthy aeration processes.

An object of the present invention is to provide a device which allows liquid stored in a container to be aerated quickly and thoroughly before use.

It is a further object of the present invention to provide a device which can be used to decant liquids from one container to another container both quickly and easily.

According to a first aspect of the present invention there is provided a device for aerating a liquid stored in a container, said device comprising a tube member having a first opening for insertion into the liquid in the container, and a second opening for location above the surface of the liquid for exposure to the atmosphere or connection to a gas, said tube member communicating with a pump means such that upon activation of said pump means, air or gas is pumped, along said tube member and into said liquid, thereby aerating said liquid without the same leaving the container.

Preferably the pump means forces atmospheric air to the bottom or near to the bottom of the container and is allowed to gently bubble to the surface, thereby ensuring that all the liquid in the container is thoroughly aerated.

According to a second aspect of the present invention there is provided an air-decant device for aerating a liquid stored in a container, said device comprising a tube member having a first opening for insertion beneath the surface of the liquid in the container, and a second opening for location above the surface of the liquid for exposure to the atmosphere, said tube member communicating with a pump means such that on activation of said pump means liquid is pumped from said container and out of said second opening end, and said liquid is directed back into said container thereby allowing aeration of said liquid.

Preferably the directing means is a funnel means and in one embodiment it has attachment members for location in or on a container.

In one embodiment a surface is provided over which the liquid can flow after leaving the second opening of the tube member prior to being directed back into the container via the funnel means. The surface can be any suitable shape for providing aeration of the liquid, for example, a dome shaped surface, a cone shaped surface, a spiral shaped surface, a stepped surface or the like can be used.

Alternatively, a nozzle can be provided on the second end of the tube member, which sprays the liquid or forms a dome shaped type flow of liquid and which can then be directed back into the container via the funnel means.

Preferably a deflector cap is provided at the second open end of the tube member to aid the flow of liquid towards the funnel means.

In one embodiment an attachment member and/or further tubing can be provided for location at the second end of said tubing member to allow liquid to be decanted from the container to a different container.

Preferably a filter/air diffuser is provided at the first end of said tube member.

The pump means can be electrically operated from the mains, battery operated and/or mechanically operated.

Preferably the pump means is contained at least in part within a housing to protect the pump mechanism from the liquid. The housing can provide the surface over which the liquid flows after leaving the second end of the tubing member. Alternatively the housing is provided in addition to the surface over which the liquid flows.

The tubing member can be a single piece construction and be a pre-determined length, suitable for a particular container. Alternatively the tubing member can comprise a number of elements which are telescopically joined, thereby allowing the length of the tubing member to be altered to fit various sized containers having variable levels of liquid contained therein and also for ease of storage.

The same pump means can be used to pump air into the container and pump liquid out of the container.

According to a third aspect of the present invention there is provided an air-decant device for aerating a liquid stored in a container, said device comprising a tube member having a first opening for insertion beneath the surface of the liquid in the container, and a second opening for location above the surface of the liquid for exposure to the atmosphere, said tube member communicating with a pump means and bubble chamber such that on activation of said pump means liquid is pumped from said container into said bubble chamber, said liquid subsequently directed back into s aid container.

In one embodiment said pump means contained within a housing and said housing communicating with the bubble chamber.

The second open end of the tube member is located in said bubble chamber and is provided with a bubble nozzle. The bubble nozzle forms a bubble of liquid, thereby allowing the liquid to be gently exposed to the air before being returned to the container, typically via a funnel means.

Preferably the bubble chamber is made from a transparent material and is provided with a lid.

It will be appreciated by a person skilled in the art that any combination of the described embodiments can be combined to provide a device falling within the scope of protection of the present invention. The present invention has the advantage that the container of liquid can be aerated or decanted from one container to another container both quickly and easily. This would allow the user to open and thoroughly breath a bottle of wine minutes before the wine is needed.

Embodiments of the present invention will now be described with reference to the following Figures, wherein.

Figure 5:
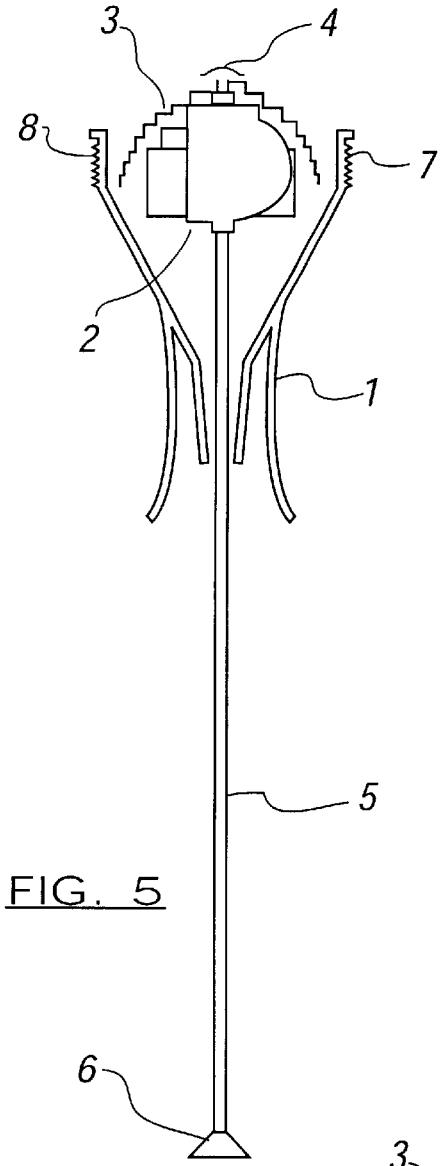
FIG. 5 is a cross-section of an air-decant device having a spiral shaped surface over which liquid can flow and a funnel means.
Figure 6:
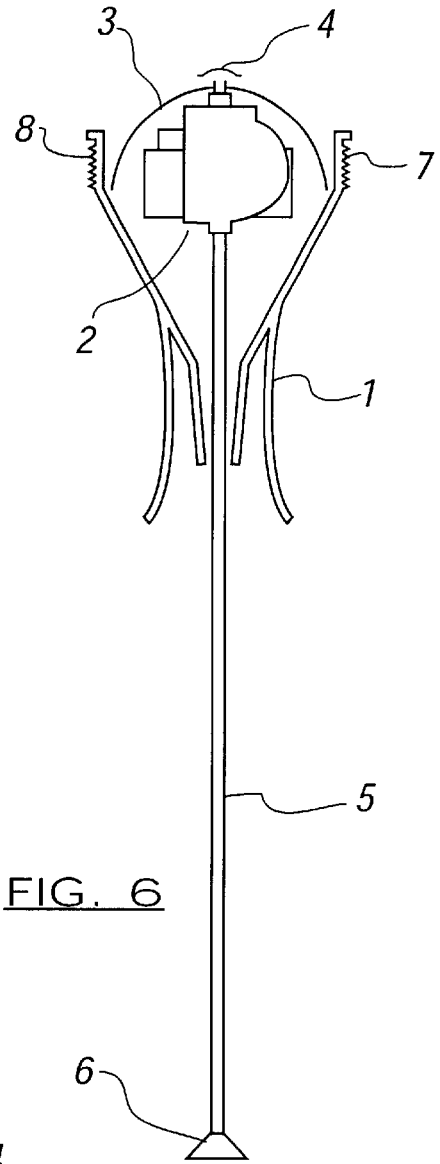
Figure 5A:
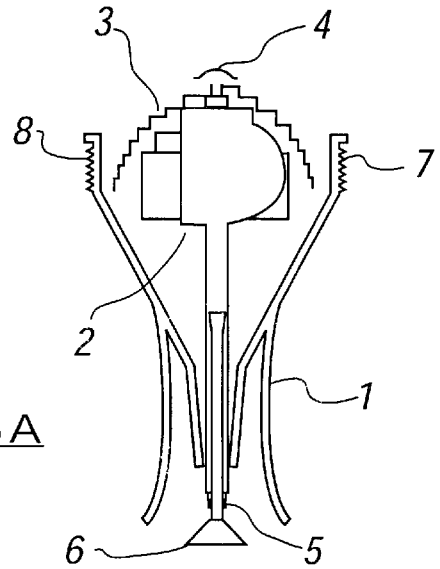
Figure 7:
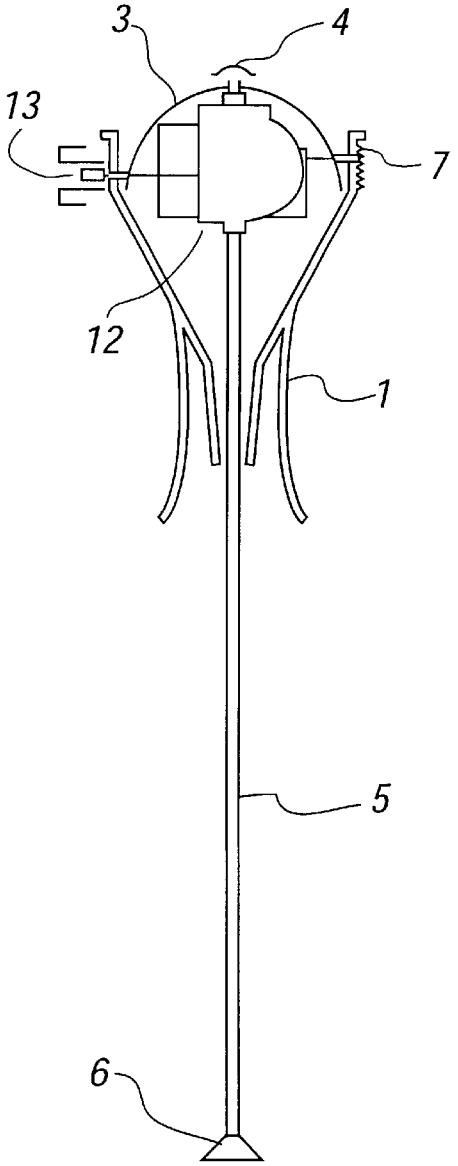
Figure 8:
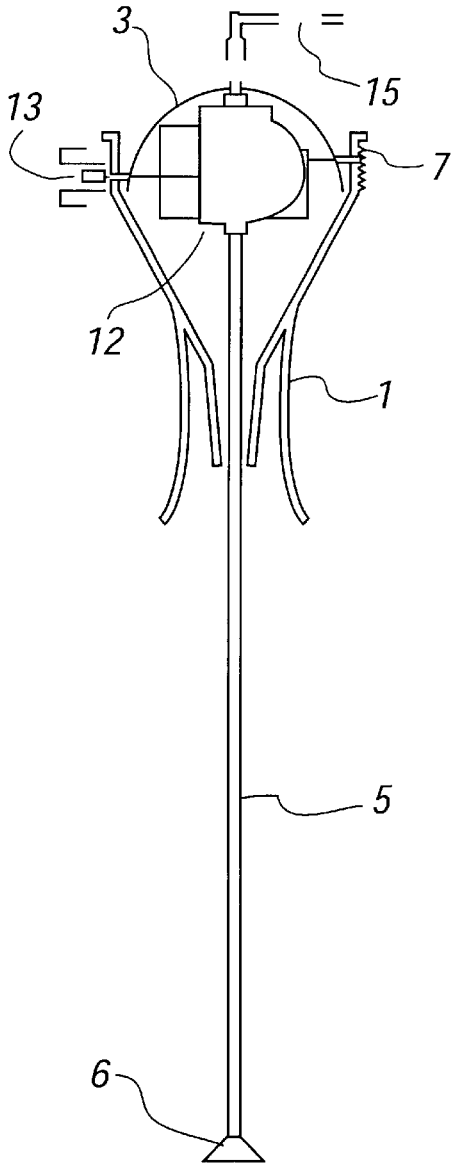
Figure 9:
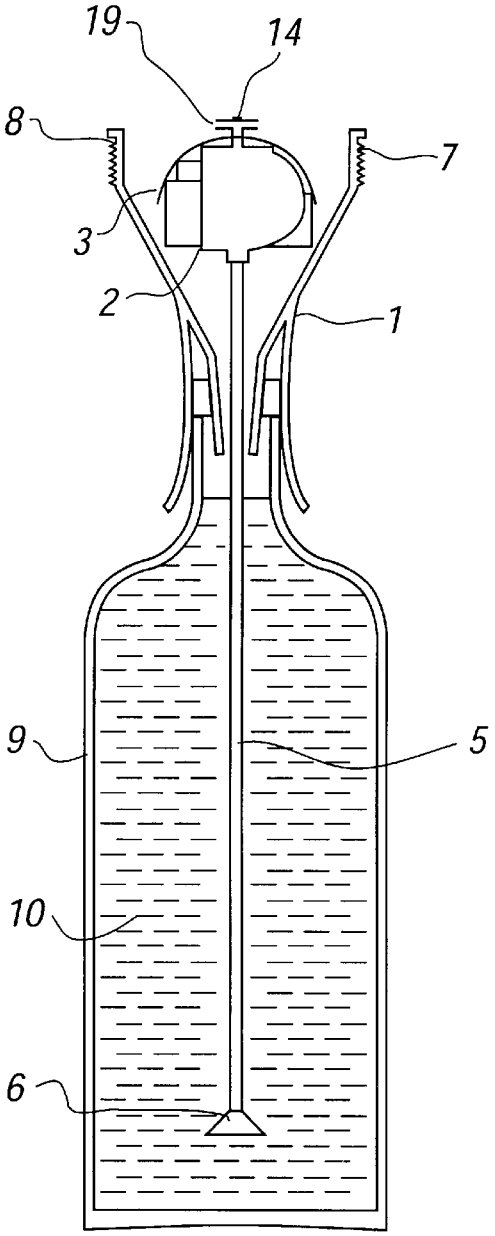
Figure 9A:
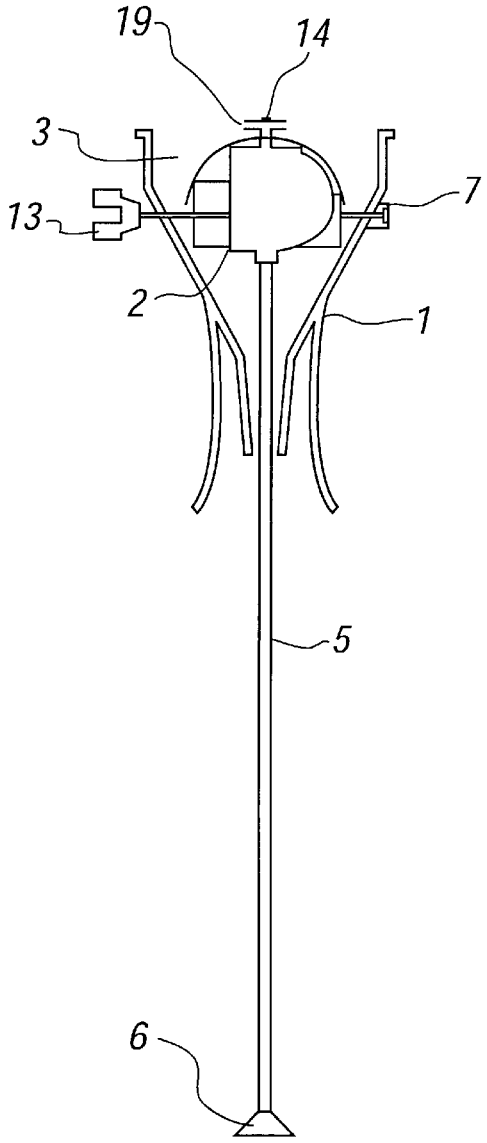
Figure 10:
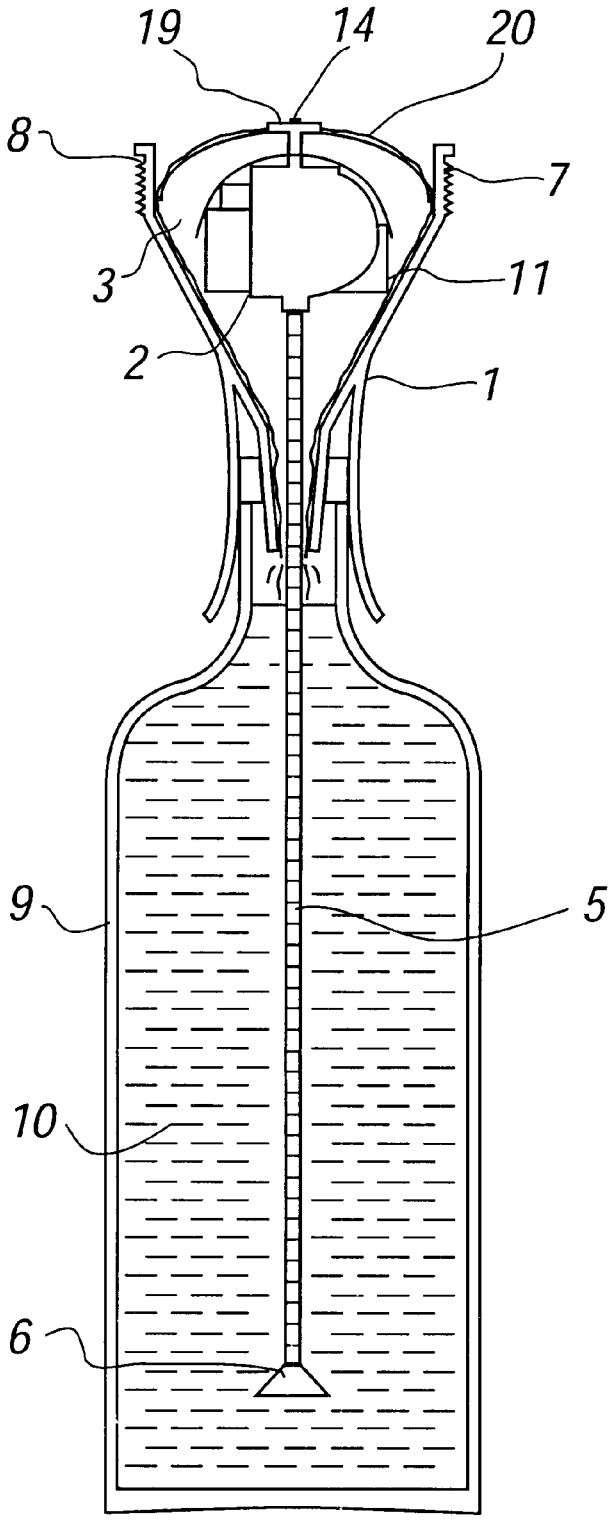
Figure 11:
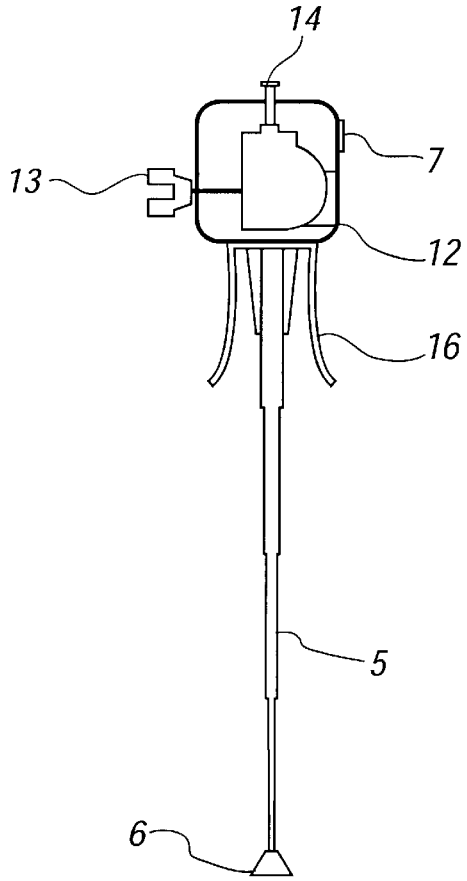
Figure 12:
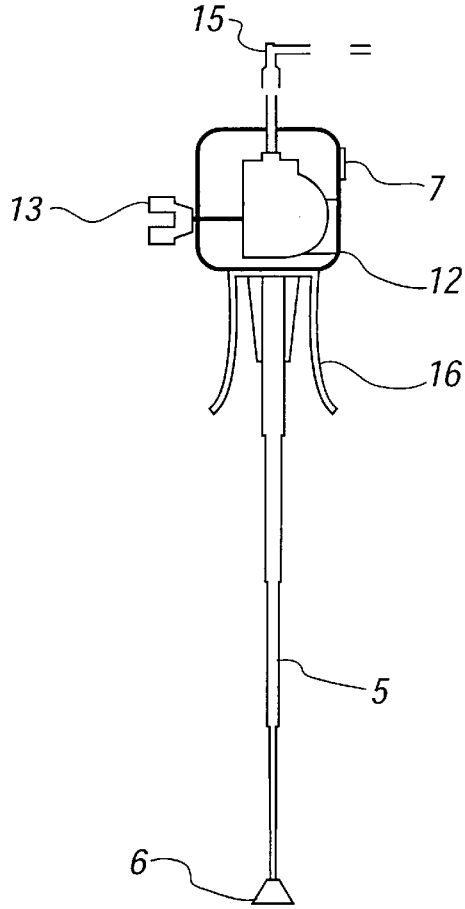
Figure 13:
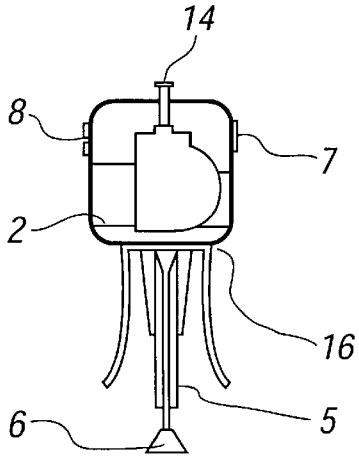
Figure 14:
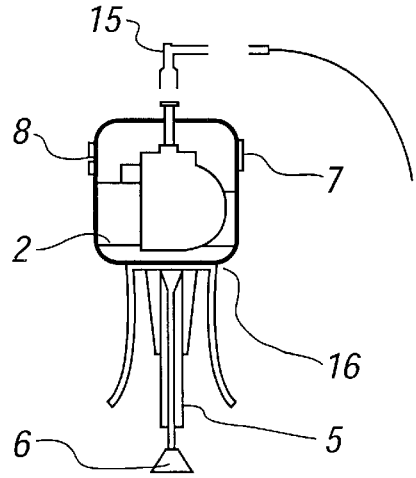
Figure 15:
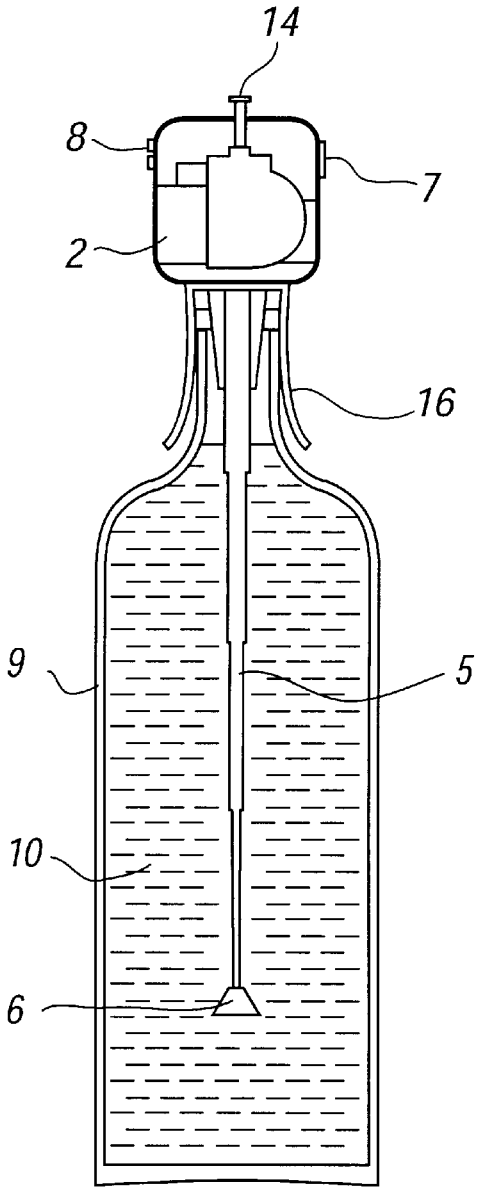
Figure 16:
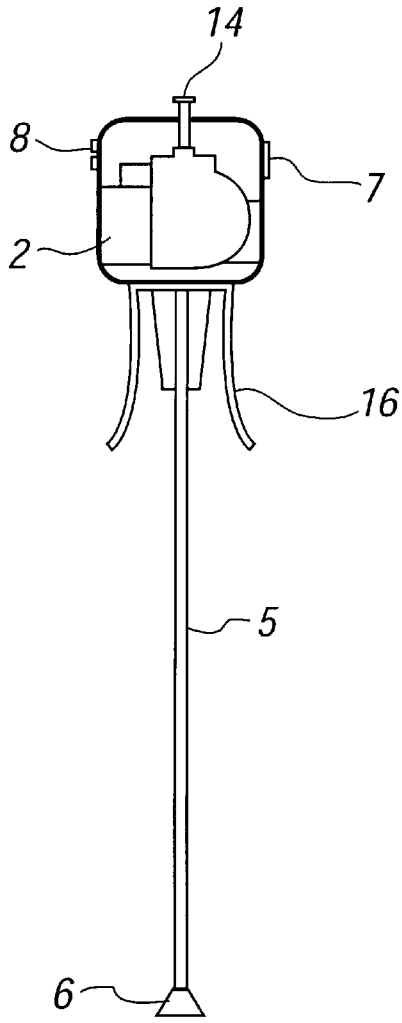
Figure 17:
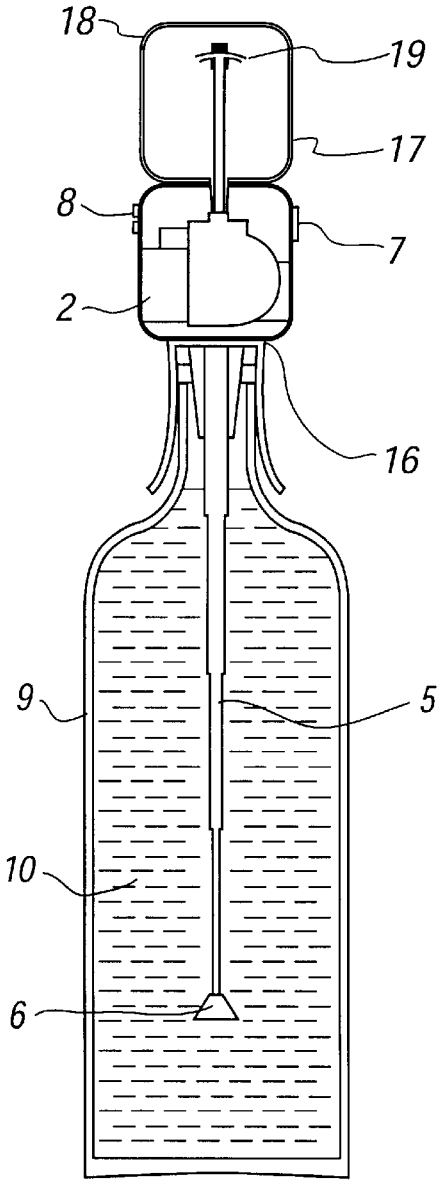
Figure 18:
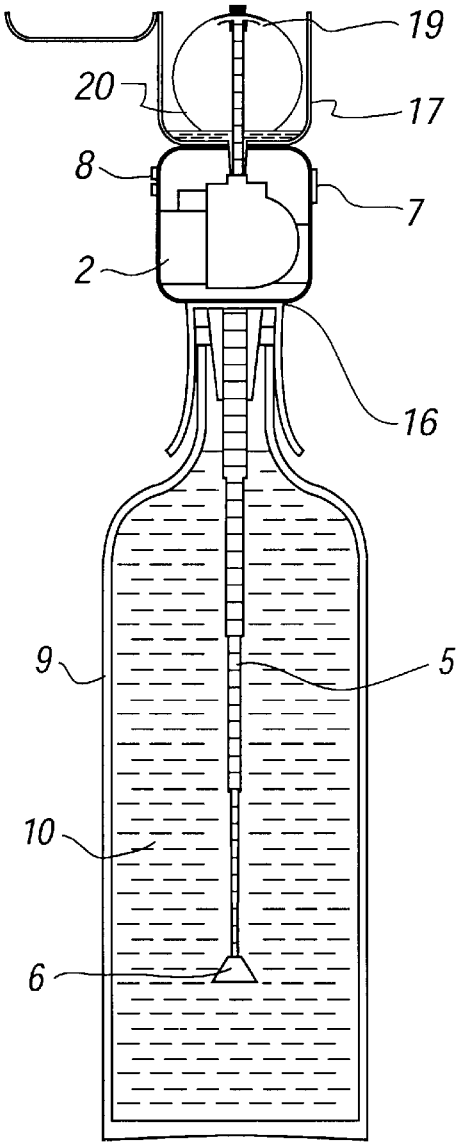
Figure 18A:
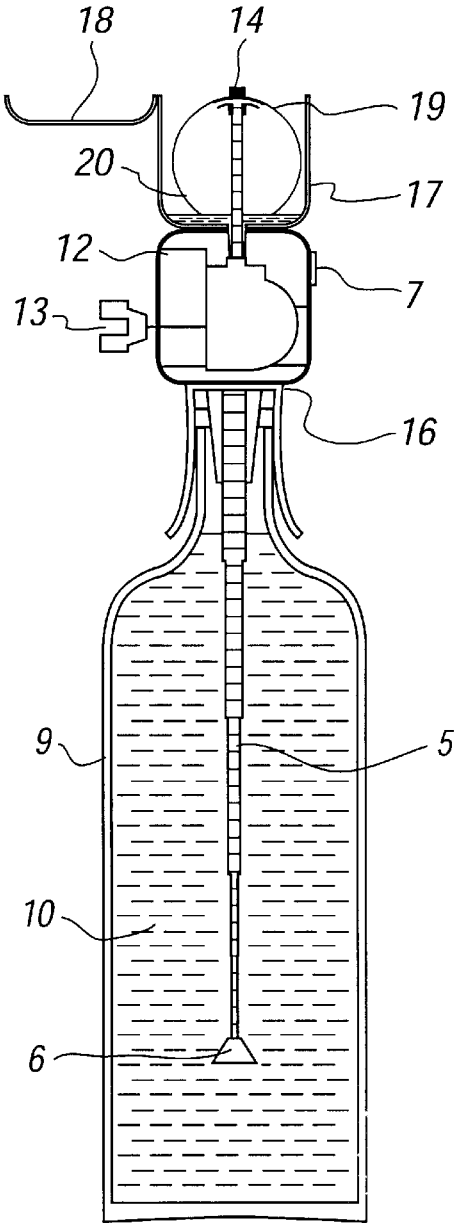
Figure 19:
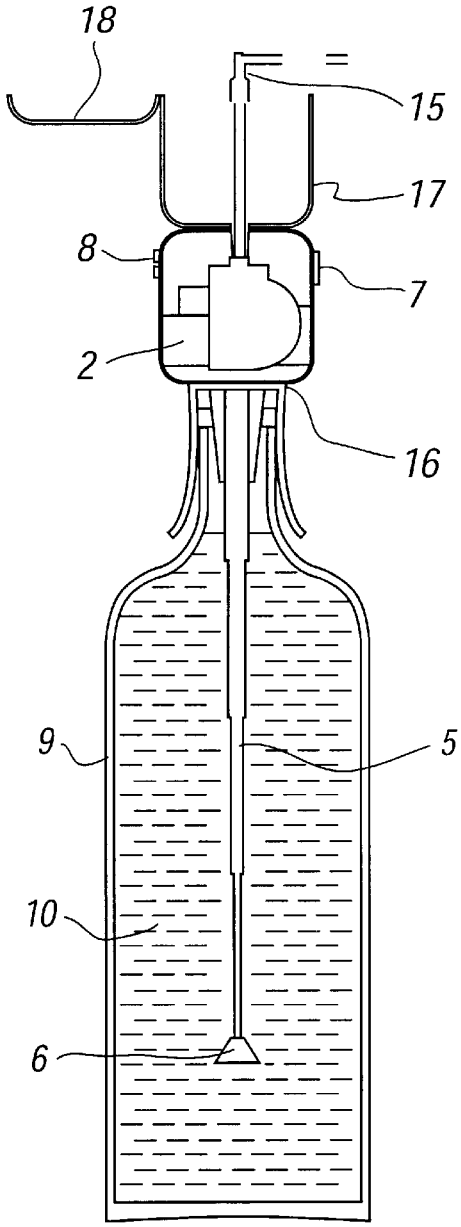

FIG. 5*a* is a cross-section of the air-decant device of FIG. 5 with the tubing member telescopically collapsed;

FIG. 6 is a cross-section of an air-decant device having a dome shaped surface over which liquid can flow and a funnel means;

FIG. 7 is a cross-section of the air-decant device in FIG. 6 having a clockwork motor powered pump;

FIG. 8 is a cross-section of the air-decant device in FIG. 7 having an attachment member for decanting;

FIG. 9 is a cross-section of an air-decant device, having a dome shaped nozzle and a decant outlet cap, located in a bottle of wine;

FIG. 9*a* is a cross-section of the air-decant device in FIG. 9 having a clockwork motor powered pump;

FIG. 10 is a cross-section of the air-decant device in FIG. 9 in operation, showing the flow of wine;

FIG. 11 is a cross-section of an air-decant device with the pump means provided in a housing and a decant outlet cap;

FIG. 12 is a cross-section of the air-decant device in FIG. 11 having an attachment member for decanting;

FIG. 13 is a cross-section of air-decant device in FIG. 11 with the tubing member telescopically collapsed;

FIG. 14 is a cross-section of the air-decant device in FIG. 12 with the tubing member telescopically collapsed;

FIG. 15 is a cross-section of the air-decant device in FIG. 11 located in a bottle or wine;

FIG. 16 is a cross-section of an air-decant device in FIG. 11 having a single piece construction tube member;

FIG. 17 is a cross-section of an air-decant device with a bubble chamber communicating the housing of the pump means, located on a bottle of wine;

FIG. 18 is a cross-section of the air-decant device in FIG. 17 showing the flow of wine;

FIG. 18*a* is a cross-section of the air-decant device in FIG. 18 having a clockwork motor powered pump;

FIG. 19 is a cross-section of the air-decant device in FIG. 18 having an attachment member for decanting.

Figure 1:
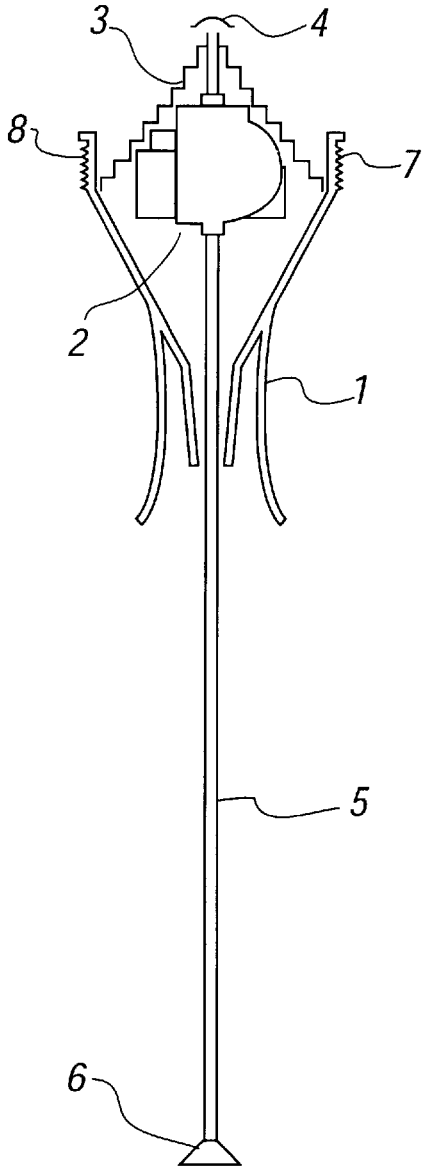
FIG. 1 is a cross-section of an air-decant device having a stepped cone surface over which liquid can flow and a funnel means.
Figure 2:
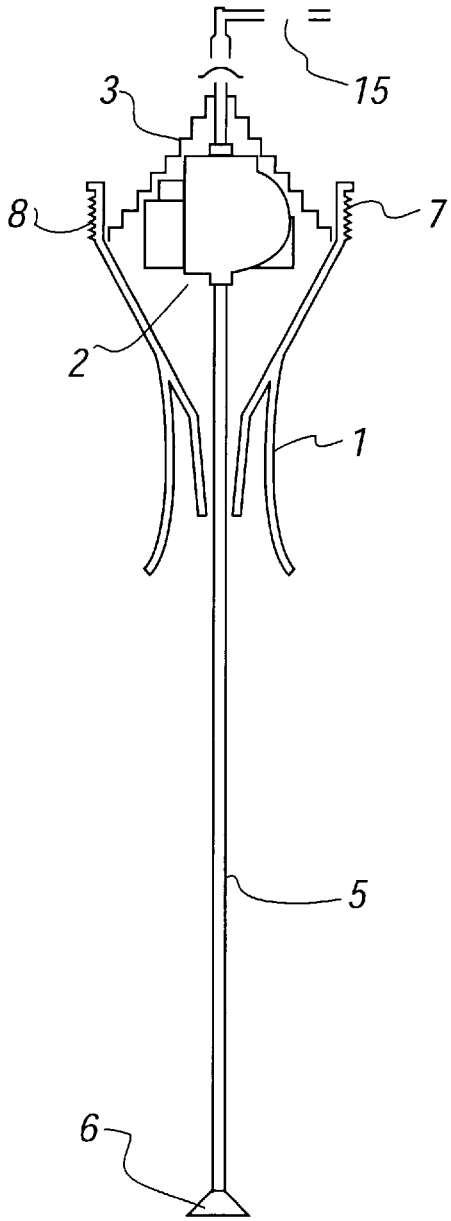
FIG. 2 is a cross-section of an air-decant device of FIG. 1 having an attachment member for decanting.

Referring to the FIG. 1, there is illustrated an air-decant device comprising a funnel means 1, a pump means 2, a surface 3 over which the aerating liquid can flow, a deflector cap 4, a tube member 5, a filter/air diffuser 6, a pump control means 7 and a rechargeable battery connection 8.

The tube member 5 has a first open end at which the filter/air diffuser 6 is located and a second open end on which the deflector cap 4 is located.

Figure 3:
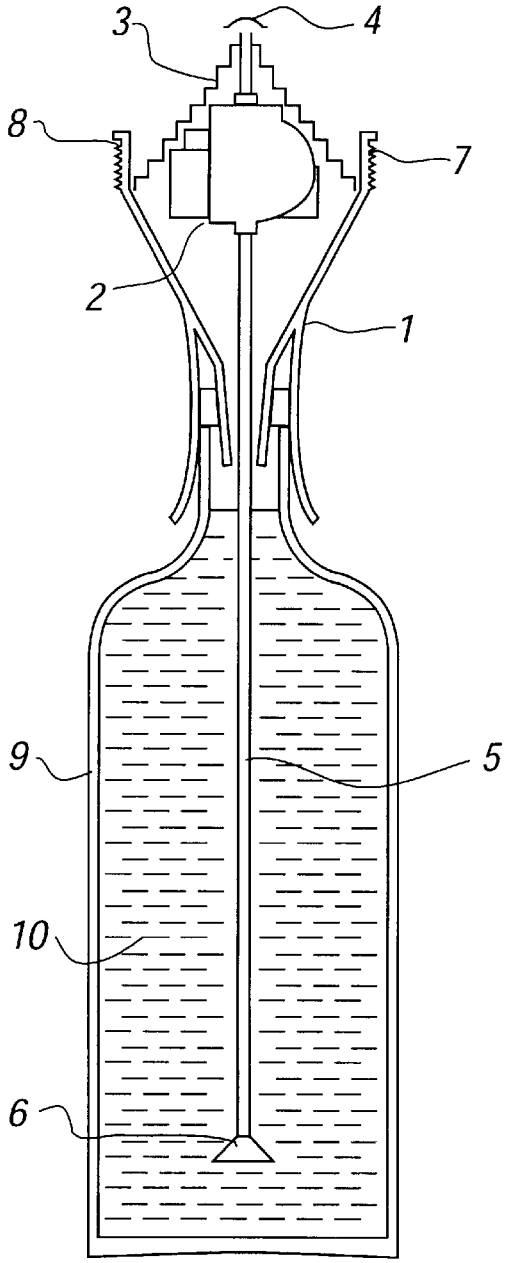
FIG. 3 is a cross-section of an air-decant device located on a bottle of wine.

In use, the funnel means 1 is located on a top of a bottle of wine 9 and is secured there via attachment members as illustrated in FIG. 3. The first end of tube member 5 with the filter/air diffuser 6 is placed below the surface of the wine 10. The second open end with the deflector cap 4 is positioned above the surface of the wine 10 for exposure to the atmosphere.

Figure 4:
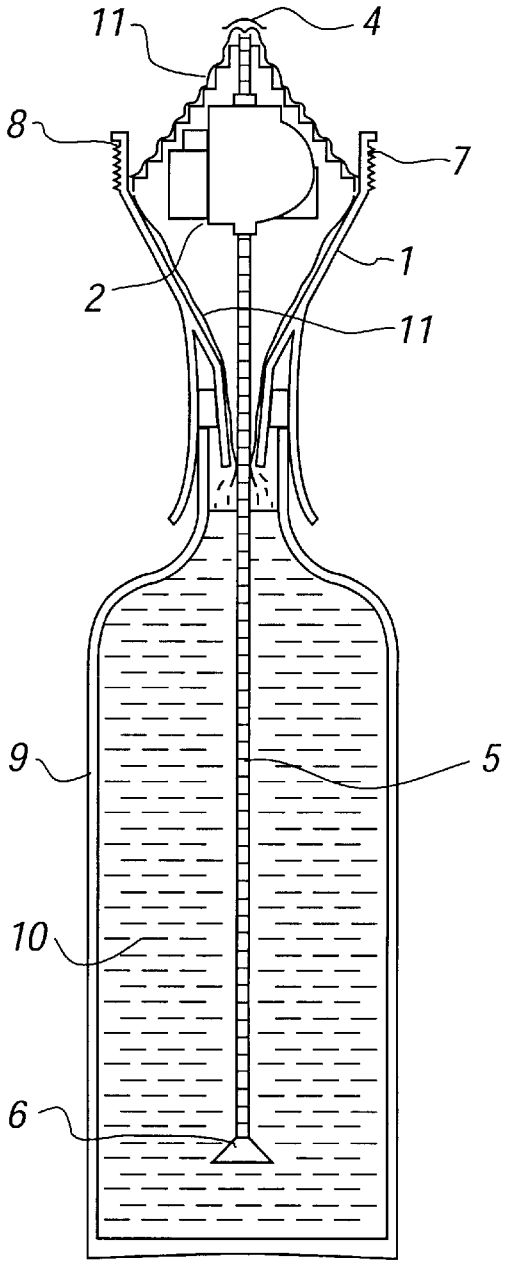
FIG. 4 is a cross-section of an air-decant device in operation, showing the flow of wine.

On activation of the pump control means 7, the wine 10 contained in the bottle 9 is pumped up through tube member 5 by the battery operated pump means 2 from the first open end to the second open end. The deflector cap 4 helps to direct the flow of wine 11 over the surface 3. The wine then flows into the funnel means 1 which directs the wine back into the bottle as illustrated in FIG. 4.

The flow of wine over the surface 3 gently exposes the wine to air, thereby aerating the wine both easily and quickly.

The deflector cap 4 can be removed and be replaced by an attachment member 15 for decanting the wine 10 from the bottle 9 to another container (not shown) as illustrated in FIGS. 2, 8, 12, 14 and 19.

The surface 3 over which the wine flows to aerate the same can be a stepped cone surface as illustrated in FIGS. 1–4, a spiral shaped surface as illustrated in FIGS. 5 and 5*a* or be a dome shaped surface as illustrated in FIGS. 7 and 8. It is noted that other suitably shaped surfaces could also be used which would provide adequate aeration of the liquid, for example a stepped surface could be used.

The tube member 5 can be a single piece construction as illustrated in FIGS. 1–10 or comprise a number of elements which are telescopically joined, thereby allowing the length of said tubing member 5 to be altered to fit various sized containers with varying liquid levels and for ease of storage, as illustrated in FIGS. 5*a*, 11–15 and 17–19.

A nozzle 19 can be provided at the second end of tube member 5 in place of deflector cap 4 as illustrated in FIGS. 9 and 9*a*. The nozzle results in spraying of the wine and/or allows the formation of a dome shaped type flow of wine 20, which is then directed back into the bottle 9 by funnel means 1, as illustrated in FIG. 10.

The pump means 2 can be battery operated and/or electrically operated as in FIGS. 1–6 or it can be mechanically operated by a clockwork mechanism, as illustrated in FIGS. 7, 8, 9*a*, 11, 12 and 18*a*. The pump means can be located within the funnel means 1 or it could be located outside of said funnel means.

The pump control means 7 can be used to turn the air-decant device on or off. In addition, the control means 7 can be used to control the speed and volume of air to the bottom of a bottle and/or control the flow of liquid to the top of the device for exposure to air or decanting.

An external connection 8 can be provided on the air-decant device to provide connection to an outside electrical supply and/or re-charge the internal batteries in the device.

The pump means 2 can be contained within a compact housing 16 and tube member 5 can pass through the same, as illustrated in FIGS. 11–16. A bubble chamber 17 can be fitted to the compact housing 16 and a bubble nozzle 19 forms a flow of wine 20 in the form of a bubble, thereby allowing the wine 10 to be gently exposed to the air before being returned to the bottle 9, as illustrated in FIGS. 18 and 18*a*.

The bubble chamber 17 can be transparent so that the user can see the wine being aerated, although non-transparent chambers of differing colours could also be used. In addition, the bubble chamber 17 can be fitted with a lid 18 so that the wine flow 20 is exposed to atmospheric air and an attachment member 15 can be fitted to allow the wine to be decanted into a different container. The wine flow 20 can be directed back through the compact housing 16 via an inlet pipe and subsequently directed back to the bottle 9.

What is claimed is:

1. An aerating device for a liquid held in a container having a body and a neck with a mouth opening, said device provided for mounting on the mouth of the container and including a surface and further having a tube member having a first opening and a second opening with the tube member extending into the liquid in the container with the first opening positioned in the liquid in the container and the second opening exposed to atmosphere, said member connected to a pump means which, when activated, draws the liquid from the first opening out of the container to exit at the second opening and characterised in that upon exit the liquid is directed via a directing means; onto the surface along which the liquid flows prior to re-entering the container through the mouth opening in an aerated condition.

2. A device according to claim 1 charactetised in that the surface along which the liquid flows is dome shaped.

3. A device according to claim 1 charactetised in that the surface along which the liquid flows is conical.

4. A device according to claim 1 charactertised in that the surface along which the liquid flows is spirally shaped.

5. A device according to claim 1 characterised in that the surface along which the liquid flows is stepped.

6. A device according to claim 1 characterised in that a nozzle is provided on the second opening of the tube member which directs the liquid onto the surface.

7. A device according to claim 1 characterised in that a deflector cap is provided at the second opening of the tube member to aid the direction of the flow of liquid onto the surface.

8. A device according to claim 1 characterised in that an attachment member and/or further tubing is provided for location at the second opening of the tube member to allow the liquid to be selectively decanted from the container to a further container.

9. A device according to claim 1 characterised in that a filter or air diffuser is provided at the first opening of the tube member.

10. A device according to claim 1 charactetised in that the pump means can be electrically operated.

11. A device according to claim 1 characterised in that the pump means is contained at least in part within a housing.

12. A device according to claim 11 characterised in that the housing is distinct from the surface over which the liquid flows after leaving the second opening of the tube member.

13. A device according to claim 11 characterised in that wherein the housing has an external surface which forms the surface over which he liquid flows after leaving the second opening of the tube member.

14. A device according to claim 1 characterised in that the tube member comprises elements which are telescopically joined.

15. A device according to claim 1 characterised in that the device includes a bubble chamber such that upon activation of said pump means liquid is pumped from said container into the bubble chamber and said liquid subsequently directed back into the container via the surface.

16. A device according to claim 15 characterised in that the bubble chamber is contained within a housing.

17. A device with a pump means for the aeration of wine in a bottle, said bottle having a body and a neck, said neck having a mouth opening, said device mounted at the mouth opening and having a tube member having a first opening and a second opening, said tube member extending into the wine and connected to a pump means to draw wine out of the bottle through the tube member to exit via the second opening to atmosphere characterised in that the wine exits the second opening and re-enters the bottle, said device having a surface, and said wine passes over said surface prior to re-entering the bottle.

18. A device for the aeration of wine in a bottle, said bottle having a body and a neck, said neck having a mouth opening, said device having a pump means, a surface, a tube member and a deflector cup and said tube member has a first opening and a second opening, said first opening extending into the wine and said tube member connected to the pump means to allow wine to be drawn from the bottle through the tube member to exit to atmosphere externally of the bottle via the second opening and wherein upon exit the wine is directed by the deflecting cap onto the surface over which the wine passes from which the wine re-enters the bottle.

* * * * *